United States Patent [19]

Bull

[11] Patent Number: 4,927,149

[45] Date of Patent: May 22, 1990

[54] PLAYING CARD HOLDER

[76] Inventor: Arthur E. Bull, 48 Laurel, Mt. Dora, Fla. 32757

[21] Appl. No.: 287,718

[22] Filed: Dec. 21, 1988

[51] Int. Cl.[5] ..... A63F 1/10

[52] U.S. Cl. ..... 273/150

[58] Field of Search ..... 273/150, 148 A; 40/124, 40/124.2, 124.4

[56] References Cited

U.S. PATENT DOCUMENTS

| | | | |
|---|---|---|---|
| D. 73,272 | 8/1927 | Teneau | 273/150 X |
| D. 286,897 | 11/1986 | Herbert | 273/150 X |
| 1,416,447 | 5/1922 | Castles | 273/150 |
| 1,955,340 | 4/1934 | McPherson | 273/150 |
| 2,665,916 | 1/1954 | Lakatos | 273/150 |
| 2,680,621 | 6/1954 | Crandall et al. | 273/150 |
| 2,729,452 | 1/1956 | Baumann | 273/150 |
| 2,811,363 | 10/1987 | McDaniel | 273/150 |
| 3,210,865 | 10/1965 | Muntz | 273/150 X |
| 3,818,905 | 6/1974 | Lebold | 273/150 X |
| 4,630,824 | 12/1986 | Sweet | 273/150 |
| 4,669,733 | 6/1987 | Sweet | 273/150 |

FOREIGN PATENT DOCUMENTS

| | | | |
|---|---|---|---|
| 731027 | 3/1966 | Canada | 273/150 |
| 758762 | 11/1933 | France | 273/150 |
| 258330 | 9/1926 | United Kingdom | 273/150 |

*Primary Examiner*—Anton O. Oechsle

*Attorney, Agent, or Firm*—Fay, Sharpe, Beall, Fagan, Minnich & McKee

[57] ABSTRACT

A playing card holder comprises a substantially pentagonal backing plate with a plurality of pinching members mounted thereon in a preselected arrangement. Each of the pinching members includes a pinch block fastened to the backing plate and a spacer disposed between the pinch block and the backing plate so that a card-gripping surface of the pinch block is spaced from the backing plate by a preselected clearance less than the thickness of a playing card. A playing card inserted in the space between the backing plate and the card-gripping surface of the pinch block is frictionally gripped therein. In an alternative embodiment, each pinching member includes a leaf spring having a card-gripping surface normally contacting the backing plate. The leaf spring elastically deforms when a playing card is inserted between the card-gripping surface and the backing plate. Preferably, the playing card holder also comprises a guide plate fixed to the backing plate and including a transparent view portion spaced apart from the backing plate and defining a guide slot therebetween. The pinching members are disposed along the bottom of the guide slot.

19 Claims, 2 Drawing Sheets

FIG. 2
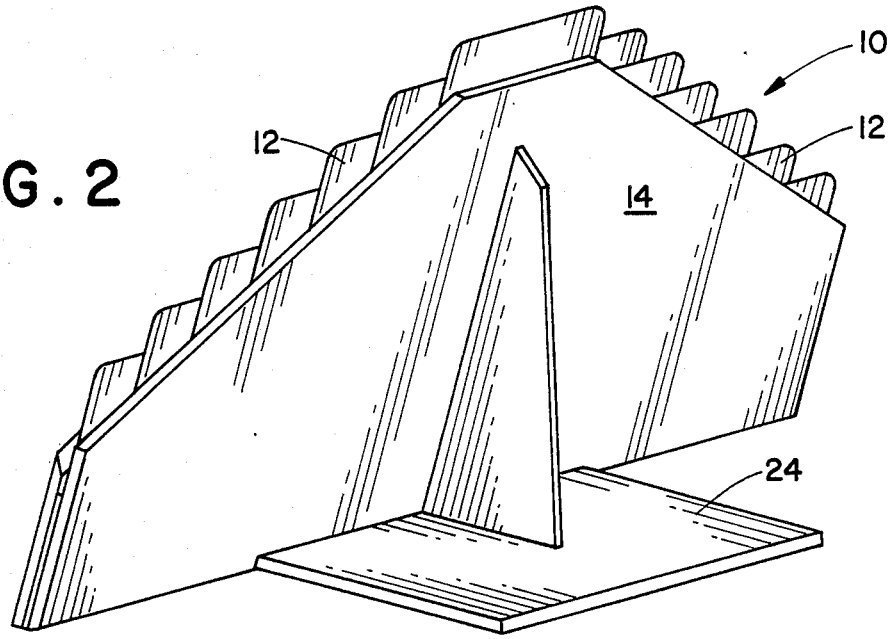
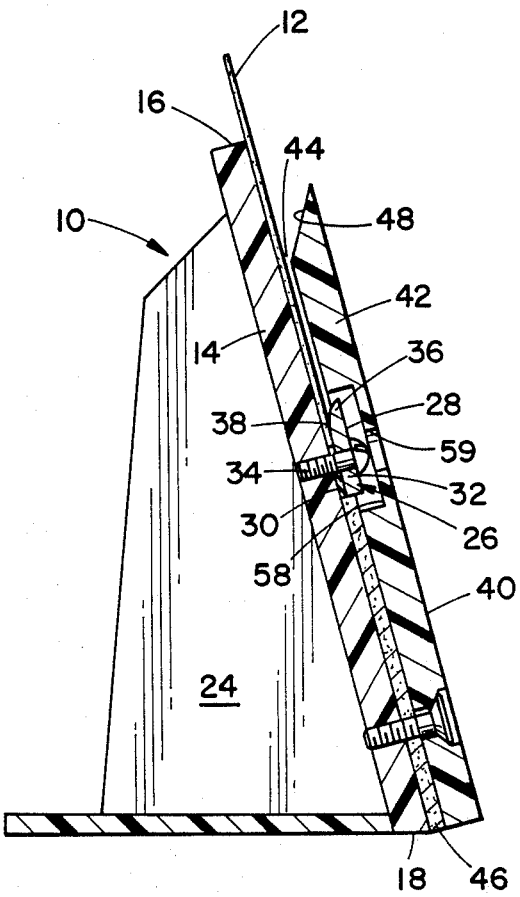
FIG. 3
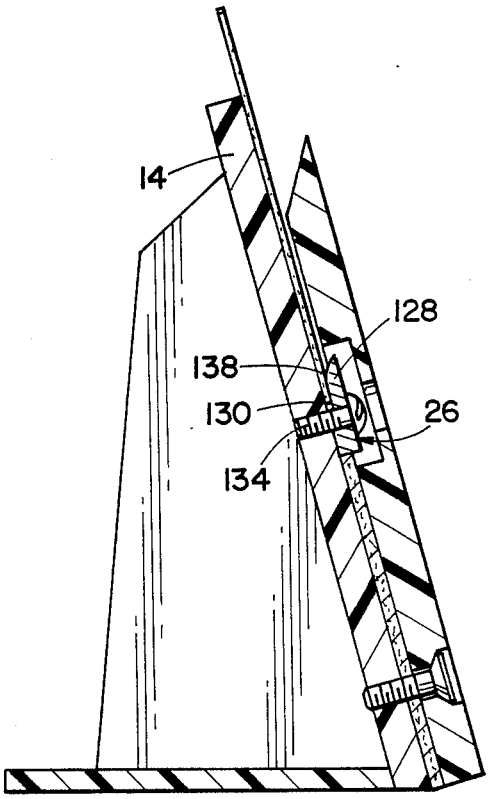
FIG. 4

PLAYING CARD HOLDER

BACKGROUND OF THE INVENTION

1. Field of the Invention

The present invention relates to a playing card holder. More particularly, the invention relates to a playing card holder that enables a person having the use of only one hand to hold and sort playing cards despite his or her handicap.

2. Description of the Related Art

Participation in a card game such as bridge is primarily a mental activity. Consequently, card playing is a particularly enjoyable activity among elderly and disabled people because it does not require a high level of physical prowess. The primary physical requirements are the ability to arrange the cards that the player is dealt into a desired order, hold the ordered cards in one hand, and discard or pick up with the other hand.

Unfortunately, the minimal physical requirements of card playing are beyond the capabilities of those who are handicapped by virtue of their lacking a usable hand or arm, including elderly persons who are prone to trembling hands. Such persons would benefit greatly from the mental stimulation and social interaction provided by card playing if they had available to them a device that could hold their cards for them in approximately the same manner that the human hand can hold cards.

Conventional card holders, such as those disclosed in U.S. Pat. Nos. 1,416,447 and 4,669,733, typically comprise a pair of rigid plates lined with felt or a similar cushioning material. The plates either are resiliently held together, such as by the springs disclosed in U.S. Pat. No. 1,416,447, or are oriented to form a narrowing groove therebetween, as in the cardholder of U.S. Pat. No. 4,669,733.

Although such conventional card holders might function adequately when new, they often become unreliable after continued use, during which the felt or other cushioning material becomes worn from repeated sliding contact with the playing cards. Because playing cards typically are about 0.01 inch thick, a small degree of wear can cause the cushioning material to lose its grip on the cards, particularly where a single card, rather than two overlapping cards, must be held. Furthermore, the cushioning material typically wears nonuniformly, making it impracticable to adjust the spacing or spring force between the plates to compensate for only the most worn areas.

The present invention is intended to provide an improved playing card holder that enables a person having only one usable hand to enjoy card playing.

The present invention also is intended to provide a playing card holder that holds cards securely, yet eliminates the need for wear-prone cushioning material.

Furthermore, the present invention is intended to provide a playing card holder that permits individual adjustment of particular portions of the card-holding mechanism, thus enabling proper compensation for wear.

SUMMARY OF THE INVENTION

The present invention overcomes the problems of the prior art card holders by providing a plurality of pinching members mounted on a backing plate in a preselected arrangement. Each of the pinching members frictionally grips a playing card.

To overcome the problems of the prior art card holders, and in accordance with the purpose of the invention, as embodied and broadly described herein, the playing card holder of this invention comprises a backing plate and a plurality of pinching members mounted on the backing plate in a preselected arrangement. The backing plate includes a top edge and a bottom edge. Each of the pinching members has a fixed end connected to the backing plate and a free end extending from the fixed end toward the top edge of the backing plate. The free end of each of the pinching members includes a card-gripping surface facing the backing plate. A playing card inserted between the backing plate and the card-gripping surface of one of the pinching members is frictionally gripped therebetween.

Preferably, the playing card holder of this invention further comprises means for holding the backing plate substantially upright and a guide plate fixed to the backing plate. The guide plate includes a transparent view portion spaced apart from the backing plate and defining a guide slot therebetween. The pinching members are disposed at the bottom of the guide slot.

In one embodiment, each of the pinching members includes a pinch block having a card-gripping surface spaced from the backing plate by a preselected clearance less than the thickness of a playing card. A playing card inserted in the space between the backing plate and the card-gripping surface of one of pinch blocks is frictionally gripped therein.

In another embodiment, each of the pinching members includes a leaf spring, and the card-gripping surface of each of the pinching members normally contacts the backing plate. The pinching member elastically deforms when a playing card is inserted between the card-gripping surface and the backing plate.

The accompanying drawings, which are incorporated in and which constitute a part of this specification, illustrate at least one embodiment of the invention and, together with the description, explain the principles of the invention.

BRIEF DESCRIPTION OF THE DRAWINGS

FIG. 2 is a perspective view of the rear quarter of the playing card holder of the present invention;

FIG. 3 is a cross-sectional view of the playing card holder of the present invention taken along line 3—3 of FIG. 1 and showing one embodiment of the pinching members of the present invention;

FIG. 4 is a cross-sectional view of the playing card holder of the present invention showing a second embodiment of the pinching members.

DESCRIPTION OF THE PREFERRED EMBODIMENTS

Figures 1, 5:
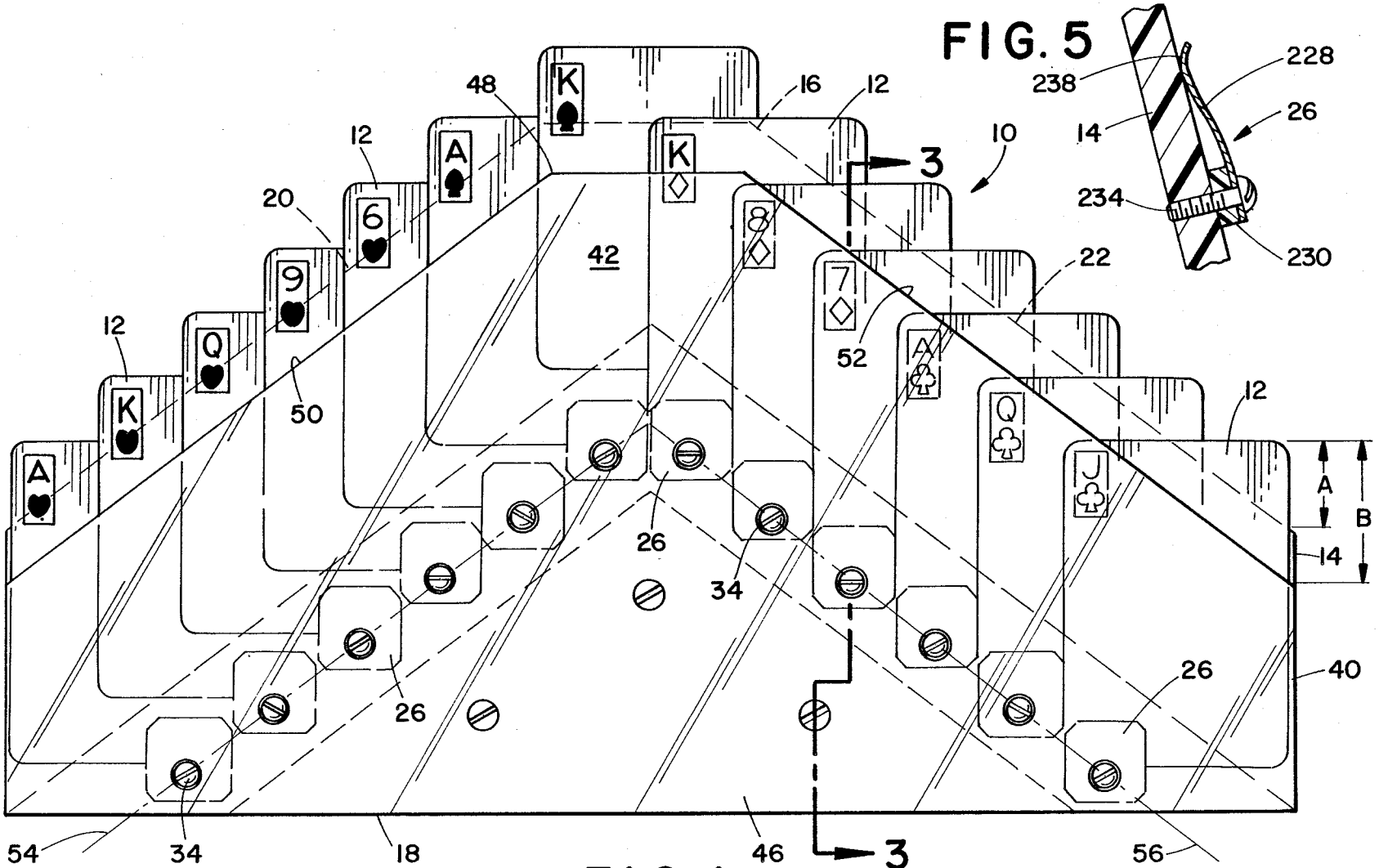
FIG. 1 is a front elevational view of the playing card holder of the present invention.
FIG. 5 is a cross-sectional view of a portion of the playing card holder of the present invention showing a third embodiment of the pinching members.

Reference now will be made in detail to the preferred embodiments of the invention, examples of which are illustrated in the accompanying drawings.

FIGS. 1–3 show a playing card holder 10 constructed in accordance with one embodiment of the present invention. As shown best in FIG. 1, card holder 10 is capable of holding and displaying a hand of thirteen cards 12 as would be required in the game of bridge. The card holder of this invention easily can be constructed to accommodate more or fewer cards, depending upon the rules of the applicable card game.

In accordance with the invention, card holder 10 includes backing plate 14, which as shown in FIGS. 1 and 2 preferably has a generally pentagonal shape. In the embodiment shown in FIG. 1, backing plate 14 includes top edge 16 and bottom edge 18. Top edge 16 preferably comprises a pair of converging, upwardly inclined backing plate edge portions 20, 22.

The card holder of this invention includes means for holding the backing plate substantially upright. As embodied in card holder 10 and as shown in FIG. 2, the holding means of this invention includes base member 24, which is fixed to the back surface of backing plate 14. As illustrated, base member 24 has a T-shape configuration, but other shapes can be employed if desired.

In accordance with the invention, card holder 10 includes a plurality of pinching members 26 mounted on backing plate 14 in a preselected arrangement. As shown in FIG. 1, pinching members 26 preferably are arranged along a pair of converging, upwardly inclined imaginary lines 54 and 56, which are substantially parallel to the respective backing plate edge portions 20 and 22. In the embodiment shown in FIG. 1, card holder 10 includes twelve pinching members 26, each of which holds a single card. The thirteenth card of the illustrated bridge hand, the king of spades, is frictionally held between its adjacent cards, the ace of spades and king of diamonds.

In the embodiment of the invention shown in FIG. 3, each pinching member 26 includes pinch block 28 and spacer 30. Each pinch block 28 has a fixed end 32 fastened to the front side of the backing plate 14 by screw 34. Each pinch block 28 also includes free end 36 extending upwardly toward top edge 16 of backing plate 14. Free end 36 includes card-gripping surface 38, which faces the front surface of backing plate 14. Pinch block 28 preferably is formed of a rigid polymer such as nylon.

In the embodiment shown in FIG. 3, spacer 30 preferably has an uncompressed thickness greater than the thickness of a playing card, for example, approximately 0.015–0.02 inch. Screw 34 compresses spacer 30 between pinch block 28 and the backing plate 14 to provide a clearance therebetween that is less than the thickness of a playing card, that is, less than about 0.01 inch. Consequently, a playing card inserted in the space between the backing plate 14 and card-gripping surface 38 of one of pinch blocks 28 is frictionally gripped therein. The width of the clearance between the backing plate 14 card-gripping surface 38 and, hence, the frictional grip imparted on a playing card can be adjusted by turning screw 34. Because each card is gripped by an individual pinch block, each card-gripping location on card holder 10 can be individually adjusted to compensate for whatever wear occurs at that location.

In accordance with the invention, card holder 10 also includes guide plate 40, which is fixed to the front side of backing plate 14 and includes transparent view portion 42 spaced apart from backing plate 14 and defining guide slot 44 therebetween. Pinching members 26 are arranged along the bottom of guide slot 44.

Guide slot 44 preferably is approximately 0.015–0.02 inch wide to provide a loose fit with respect to a playing card inserted therein. View portion 42 of guide plate 40 guides a playing card being inserted between backing plate 14 and card-gripping surface 38 of a pinching member 26. Although most able-bodied card players can easily insert a playing card between card-gripping surface 38 and backing plate 14 without the presence of a guide plate, guide plate 40 provides a valuable assistance to a player having trembling hands by guiding the playing card into engagement with pinching member 26.

In the embodiment shown in FIG. 3, the preferred width of guide slot 44 is provided by shim 46, which is disposed between the lower portion of guide plate 40 and backing plate 14. Shim 46 preferably is a paper shim having a thickness of about 0.015–0.02 inch. As shown in FIG. 1, shim 46 preferably is triangular in shape and is positioned below pinching members 26.

With continued reference to FIG. 1, view portion 42 of guide plate 40 includes top edge 48, which preferably has a pair of converging, upwardly inclined guide plate edge portions 50 and 52 substantially parallel to backing plate edge portions 20 and 22, respectively. To provide further assistance in guiding playing cards into engagement with pinching members 26, the surface of top edge 48 of view portion 42 preferably is beveled and inclines downwardly toward backing plate 14. As shown in FIG. 3, guide plate 40 includes recess 58 formed therein by, for example, a routing process to provide clearance over pinching members 26. Guide plate 40 also includes holes 59 to provide access to screws 34 for adjusting the frictional grip of pinching members 26.

As shown in FIG. 1, backing plate edge portions 20, 22 and guide plate edge portions 50, 52 are disposed and pinching members 26 are arranged such that, when the lower, inside corner of a playing card 12 is gripped by a pinching member 26, the opposite corner extends above the top edge of backing plate 14 by a vertical dimension A and above the top edge of guide plate 40 by a vertical dimension B to enable the player to grasp the card easily. Preferably, dimension A is approximately 1 inch and dimension B is approximately 1.5 inches.

In accordance with another embodiment of the invention and as shown in FIG. 4, each pinching member 26 includes pinch block 128, which has formed integral therewith spacer portion 130. Pinch block 128 is fastened to backing plate 14 by screw 134. The clearance between backing plate 14 and card-gripping surface 138 of pinch block 128 can be adjusted by turning screw 134, but the relative incompressibility of spacer portion 130 limits the degree of adjustment available in this second embodiment.

In accordance with a third embodiment of the present invention and as shown in FIG. 5, each pinching member 26 includes leaf spring 228 and spacer 230 fastened to backing plate 14 by screw 234 Card-gripping surface 238 of leaf spring 228 normally contacts the front surface of backing plate 14, but leaf spring 228 elastically deforms when a plating card is inserted between card-gripping surface 238 and backing plate 14 to frictionally grip the playing card therebetween.

It will be apparent to those skilled in the art that other modifications and variations can be made in the card holder of this invention. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A holder for playing cards, comprising:

a backing plate having a top backing plate edge; and a plurality of pinching members mounted on said backing plate in a preselected arrangement, each of said pinching members including a pinch block having a fixed end connected to said backing plate and a free end extending from said fixed end toward said top backing plate edge, said free end of each of said pinch blocks including a card-gripping surface facing said backing plate, each of said pinching members also including a spacer disposed between said respective pinch block and said backing plate to define a clearance space between said card-gripping surface of said respective pinch block and said backing plate, each of said clearance spaces having a width less than the thickness of a playing card so that a playing card inserted in any of said clearance spaces is fictionally gripped between said backing plate and said card-gripping surface of said respective pinch block.

2. The holder of claim 1, further comprising means for holding said backing plate substantially upright.

3. The holder of claim 1, wherein:

each of said pinching members includes a threaded fastener fastening said pinch block and said spacer to said backing plate;

each of said spacers has an uncompressed thickness greater that the thickness of a playing card; and said threaded fastener compresses said spacer to a thickness less than the thickness of a playing card.

4. The holder of claim 1, further comprising a guide plate fixed to said backing plate, said guide plate including a transparent view portion spaced apart from said backing plate and defining a guide slot therebetween, said pinching members defining the bottom of said guide slot.

5. The holder of claim 8, wherein said view portion of said guide plate includes a top edge guide plate having a beveled edge surface inclined downwardly toward said backing plate.

6. The holder of claim 4, wherein:

said top backing plate edge includes a pair of converging, upwardly inclined backing plate edge portions;

said view portion of said guide plate includes a top guide plate edge having a pair of converging, upwardly inclined guide plate edge portions substantially parallel to said backing plate edge portions; and said pinching members are arranged along a pair of converging, upwardly inclined imaginary lines substantially parallel to said backing plate edge portions.

7. The holder of claim 6, wherein said pinching members are arranged such that a playing card inserted in any of said clearance spaces has at least one corner extending above said top backing plate edge and said top guide plate edge.

8. The holder of claim 6, wherein said backing plate edge portions and said guide plate edge portions are disposed and said pinching members are arranged such that a playing card inserted in any of said clearance spaces has at least one corner extending above said top backing plate edge by approximately 1 inch and extending above said top guide plate edge by approximately 1.5 inches.

9. A holder for playing cards, comprising:

a backing plate having a top backing plate edge including a pair of converging, upwardly inclined backing plate edge portions; and a plurality of pinching members mounted on said backing plate in a preselected arrangement, each of said pinching members including a pinch block having a fixed end connected to said backing plate and a free end extending from said fixed end toward said top edge of said backing plate, said free end of each of said pinch blocks including a card-gripping surface facing said backing plate, each of said pinching members also including a spacer disposed between said receptive pinch block and said backing plate to define a clearance space between said card-gripping surface of said respective pinch block and said backing plate, each of said clearance spaces having a width less than the thickness of a playing card so that a playing card inserted in any of said clearance spaces is frictionally gripped between said backing plate and said card-gripping surface of said respective pinch block, said pinching members being arranged on said backing plate such that a playing card inserted in any of said clearance spaces has at least one corner extending above said top backing plate edge.

10. The holder of claim 9, wherein said pinching members are arranged along a pair of converging, upwardly inclined imaginary lines substantially parallel to said backing plate edge portions.

11. The holder of claim 10, wherein said backing plate edge portions are disposed and said pinching members are arranged such that a playing card inserted in any of said clearance spaces has at least one corner extending above said top backing plate edge by approximately 1 inch.

12. The holder of claim 9, further comprising a guide plate fixed to said backing plate, said guide plate including a transparent view portion spaced apart from said backing plate and defining a guide slot therebetween, said view portion of said guide plate having a top guide plate edge including a pair of converging, upwardly inclined guide plate edge portions, said pinching members defining the bottom of said guide slot.

13. The holder of claim 13, wherein said top guide plate edge portions are disposed such that a playing card inserted in any of said clearance spaces has at least one corner extending above said top guide plate edge.

14. The holder of claim 12, wherein said backing plate edge portions and said guide plate edge portions are disposed and said pinching members are arranged such that a playing card inserted in any of said clearance spaces has at least one corner extending above said top backing plate edge by approximately 1 inch and extending above said top guide plate edge by approximately 1.5 inches.

15. A holder for playing cards, comprising:

a backing plate having a top backing plate edge including a pair of converging, upwardly inclined backing plate edge portions;

a guide plate fixed to said backing plate, said guide plate including a transparent view portion spaced apart from said backing plate and defining a guide slot therebetween, said view portion of said guide plate having a top guide plate edge including a pair of converging, upwardly inclined guide plate edge portions substantially parallel to said backing plate edge portions; and a plurality of pinching members mounted on said backing plate along a pair of converging, upwardly inclined imaginary liens substantially parallel to said backing plate edge portions, said pinching members defining the bottom of said guide slot, each of said pinching members having a fixed end connected to said backing plate and a free end extending from said fixed end toward said to backing plate edge, said free end of each of said pinching members including a card-gripping surface facing said backing plate, a playing card inserted between said backing plate and said card-gripping surface of any of said pinching members being frictionally gripped therebetween.

16. The holder of claim 15, wherein said card-gripping surface of each of said pinching members normally contacts said backing plate, said pinching member elastically deforming when a playing card is inserted between said card-gripping surface and said backing plate.

17. The holder of claim 16, wherein each of said pinching members includes a leaf spring.

18. The holder of claim 15, wherein said pinching members are arranged such that a playing card disposed between said backing plate and said card-gripping surface of one of said pinching members has at least one corner extending above said top backing plate edge and said top guide plate edge.

19. The holder of claim 15, wherein said backing plate edge portions and said guide plate edge portions are disposed and said pinching members are arranged such that a playing card disposed between said backing plate and said card-gripping surface of one of said pinching members has at least one corner extending above said top backing plate edge by approximately 1 inch and extending above said top guide plate edge by approximately 1.5 inches.

* * * * *